US007036243B2

(12) United States Patent
Doh et al.

(10) Patent No.: US 7,036,243 B2
(45) Date of Patent: May 2, 2006

(54) LAUNDRY DRYER AND CONDENSER ASSEMBLY THEREOF

(75) Inventors: Young Jin Doh, Busan-si (KR); Soon Jo Lee, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/016,710

(22) Filed: Dec. 21, 2004

(65) Prior Publication Data

US 2005/0132594 A1 Jun. 23, 2005

(30) Foreign Application Priority Data

Dec. 22, 2003 (KR) ..... 10-2003-0094465
Dec. 22, 2003 (KR) ..... 10-2003-0094466
Dec. 23, 2003 (KR) ..... 10-2003-0094468

(51) Int. Cl.
*F26B 19/00* (2006.01)

(52) U.S. Cl. ..... 34/595

(58) Field of Classification Search ..... 34/595, 34/596, 600–603
See application file for complete search history.

(56) References Cited

U.S. PATENT DOCUMENTS 2,752,694 A * 7/1956 McCormick ..... 34/60
3,538,641 A * 11/1970 Lux et al. ..... 49/192
4,023,304 A * 5/1977 Singer ..... 43/54.1

* cited by examiner

*Primary Examiner*—S. Gravini
(74) *Attorney, Agent, or Firm*—Birch, Stewart Kolasch & Birch,LLP

(57) ABSTRACT

A laundry dryer includes a base, a condenser receiving unit formed in the base, and a condenser inserted in the condenser receiving unit and provided with an insertion member.

25 Claims, 10 Drawing Sheets

LAUNDRY DRYER AND CONDENSER ASSEMBLY THEREOF

BACKGROUND OF THE INVENTION

1. Field of the Invention

The present invention relates to a laundry dryer, and more particularly, to a laundry dryer having a condenser assembly that is designed to prevent high temperature/moisture circulating air passing through a condenser and/or low temperature interior air introduced by a cooling fan from leaking through a gap formed on a front and/or rear sides of the condenser.

2. Description of the Related Art

Generally, a drum-type laundry dryer is designed to perform the drying operation while rotating laundry loaded in a dry drum. The laundry rotates and drops by the rotation of the laundry drum. High-temperature dry air introduced into the dry drum is mixed with the laundry to vaporize the moisture soaked in the laundry. The laundry dryer may be classified into a condenser-type dryer and an exhaust-type dryer. The former is designed such that the air in the dry drum is directed to a condenser and a heater and is then returned to the dry drum. That is, the air circulates in the dryer without being exhausted out of the dryer. The latter is designed such that the air in the dry drum is directed to the condenser so that the moisture contained in the air can be eliminated and is then exhausted out of the dryer.

Describing in more detail, in the condenser-type dryer, the air circulating in the dryer absorbs the moisture from the laundry loaded in the drum and passes through the condenser to be lowered in its temperature by a heat-exchange. As the temperature of the air is lowered, the moisture contained in the air is condensed. The condensed water is pumped out by a condensing pump and is then exhausted to an exterior side.

In the exhaust-type dryer, high-temperature high-moisture air absorbing moisture from the laundry in the drum is exhausted out of the dryer via a lint filter.

In both the exhaust-type and condenser type dryers, as the laundry lifts and drops by the rotation of the drum, heat-exchange is briskly incurred.

Particularly, in the condenser type dryer, the condenser functioning to condense interior air formed into high temperature/moisture state while passing through an inside of the drum should be designed to maintain a perfect seal when it is assembled in a condenser receiving unit. When the perfect seal is not realized, the condensed water generated when the air in the drum passes through the condenser cannot be transferred to the sump but leaked out of the dryer. The moisture contained in the circulating air that is leaked out of the condenser may be condensed on a surface of a base in which the condensed water is received.

In addition, when the condenser is assembled in the dryer, frictional force is generated as a bottom of the condenser surface-contacts a bottom of the condenser receiving unit, thereby making it difficult to easily assembly the condenser in the dryer.

In addition, there is a need for a handle that can be used to remove the condenser when it is intended to clean and replace the condenser.

SUMMARY OF THE INVENTION

Accordingly, the present invention is directed to a condenser assembly of a laundry dryer that substantially obviates one or more problems due to limitations and disadvantages of the related art.

An object of the present invention is to provide a condenser assembly of a laundry dryer that can provide a perfect seal when a condenser is assembled in the laundry dryer.

Another object of the present invention is to provide a condenser assembly of a laundry dryer that has a handle making it easy to insert and remove a condenser into or from the laundry dryer.

Another object of the present invention is to provide a condenser assembly of a laundry dryer that allows a condenser to be smoothly inserted into a laundry dryer.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a laundry dryer comprising: a base; a condenser receiving unit formed in the base; and a condenser inserted in the condenser receiving unit and provided with an insertion fastening member.

In another aspect of the present invention, there is provided a laundry dryer comprising: a condenser; a handle ring formed on a front portion of the condenser; an insertion fastening member rotatably mounted on the front portion of the condenser; a base having a concave portion for receiving the condenser, the base being provided at a concave portion with a groove in which the insertion fastening member is coupled; and a sealing surface elevated from the concave portion by a predetermined height.

In still another aspect of the present invention, there is provided a laundry dryer comprising: a dry drum; a condenser in which circulating air passing through the dry drum is introduced and heat-exchanged with interior air; a base having a receiving unit for receiving the condenser; an insertion fastening member mounted on front both sides of the condenser to allow the condenser to tightly contact the receiving unit; and a guide rib formed in the receiving unit to allow the condenser to be smoothly inserted.

By the above-described condenser assembly for the laundry dryer, a user can easily mount and remove the condenser into or from the dryer.

In addition, since the condenser can be assembled in the dryer with the perfect seal, the leakage of the condensed water generated on the condenser out of the dryer can be prevented.

Furthermore, when the condenser is inserted into the dryer, the condenser can be smoothly inserted.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
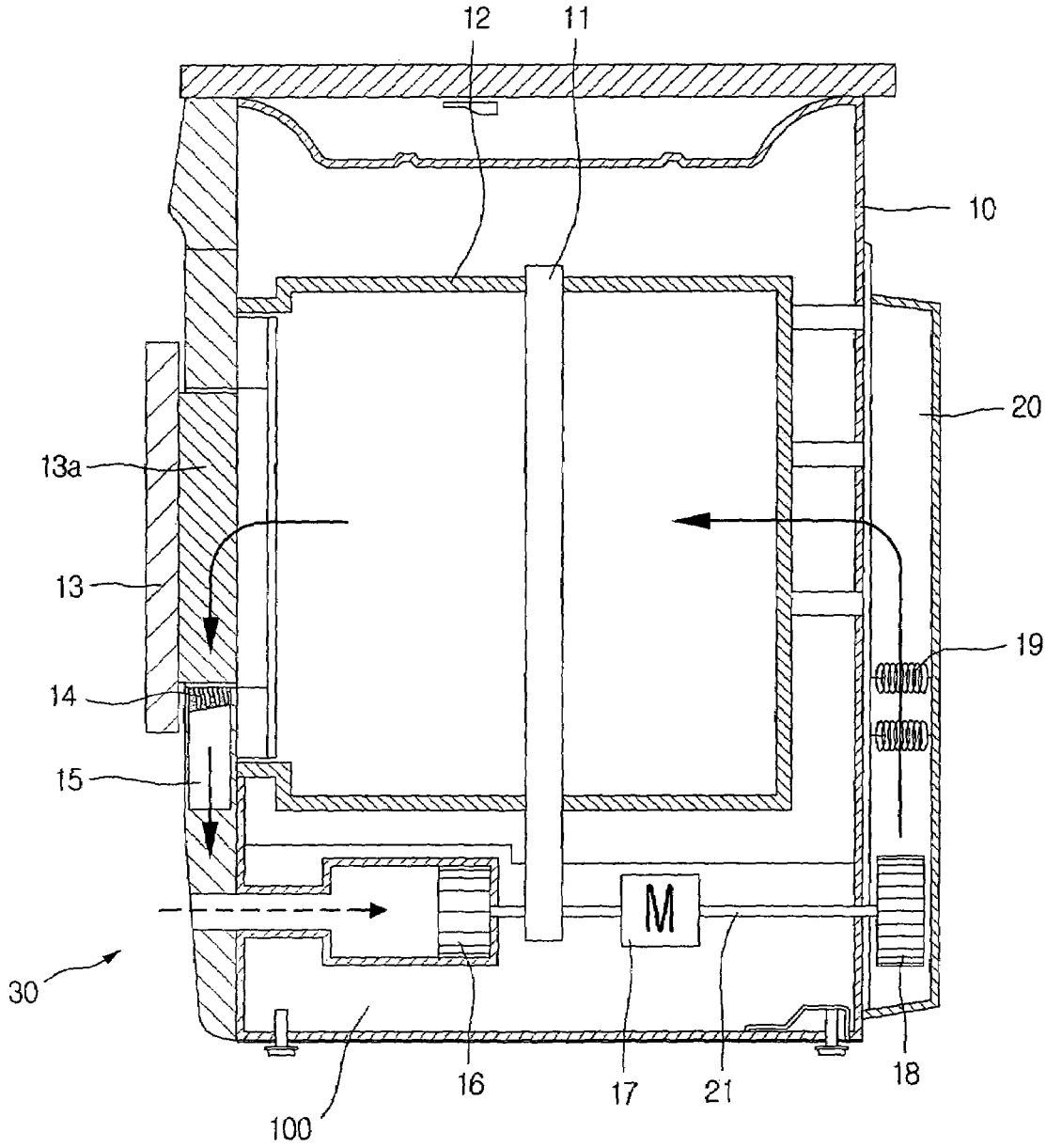
FIG. 1 is a sectional view of a condenser-type laundry dryer with a condenser assembly according to an embodiment of the present invention.

FIG. 1 is a sectional view of a condenser-type laundry dryer with a condenser assembly according to an embodiment of the present invention.

Referring to FIG. 1, a condenser-type laundry dryer 30 includes an outer case 10, a cylindrical drum 12 mounted in the outer case 10 to receive the laundry therein, a door 13 controlling the opening of the drum 12, and a belt 11 disposed around an outer circumference of the drum 12 to rotate the drum 12.

The condenser-type laundry dryer 30 further includes a motor shaft 21 connected to the belt 11 to transmit rotational force to the drum 12, a motor 17 for transmitting the rotational force to the motor shaft 21, and a cooling fan 16 connected to a first end of the motor shaft 21 to rotate by receiving the rotational force of the motor 17 and intake interior air. The laundry dryer 30 further includes a dry fan 18 connected to a second end of the motor shaft 15 to circulate air in the drum 12, a duct cover 20 connecting the dry fan 18 to the drum 12 to allow the air introduced by the dry fan 18 to be directed to the drum 12, and a base 100 for mounting the motor 17 and receiving the cooling fan 16 and a dry fan 18.

The cooling fan 16 and the dry fan 18 are disposed facing each other and the motor 17 is disposed between the cooling and dry fans 16 and 18. The dry fan 18 and the heater 19 are received in the duct cover 20 defining an air passage through which the circulating air introduced by the dry fan 10 is directed reward of the drum 12.

The dryer 30 is formed on a rear surface of the door 13, including a door lint filter 13*a* for primarily filtering foreign objects contained in the circulating air and a body lint filter 14 for secondary filtering foreign objects contained in the circulating air passing through the door lint filter 13*a*. There is provided a circulation duct 15 along which the circulating air passing through the body lint duct 14 is directed to a condenser (not shown).

The operation of the above-described laundry dryer will be described hereinafter.

When electric power is applied to the dryer 30, the motor 17 is operated and the heater 19 mounted in the duct cover 20 is heated. Then, the belt 11 connected to the motor shaft 21 rotates to rotate the drum 12. As the drum 12 rotates, the laundry in the drum 12 is lifted and dropped by a lift (not shown) mounted on the inner wall of the drum 12.

Meanwhile, the dry fan 18 connected to the motor shaft 21 rotates by the rotation of the motor 17 to introduce the circulating air via the condenser 200. The air flows upward along the duct cover 20 and passes through the heater 19 to be converted into high-temperature/dry air. Then, the air is directed into the drum to absorb the moisture contained in the laundry, thereby being converted into the high-temperature/damp air.

The high-temperature/damp air is directed to the condenser 200 along the circulation duct 15 via the door lint filter 13*a* and the body lint filter 14.

Meanwhile, as the cooling fan 16 connected to the motor shaft 21 rotates, interior air out of the dryer 30 is induced into the dryer 30. The interior air is directed to the condenser 200 via the cooling fan 16. The high-temperature/damp air and the interior air are not mixed with each other but heat-exchanged.

Accordingly, the high-temperature/damp air gives heat to the interior air as it goes through the condenser 200, thereby being changed into low-temperature/damp air, in the coursed of which the moisture contained in the low-temperature/damp air is condensed. The condensed moisture is dropped on the surface of the condenser 200 and is then directed to a sump (150 in FIG. 2).

The moisture directed to the sump 150 is transmitted to a drawer (not shown) disposed on an upper portion of the dryer 300. Meanwhile, the interior air passing through the condenser 200 takes the heat from the high-temperature/damp air to change the circulating air into the low-temperature/damp air. As a result, the temperature of the interior air is increased.

Here, the circulating air introduced by the dry fan 18 flows along the passage defined by the duct cover 20. Then, as it passes through the heater 19, it is changed into the high-temperature/dry air and is then directed into the drum 12.

As described above, the circulating air circulates in the order of the drum, the lint filters, the condenser and the duct cover.

Figure 2:
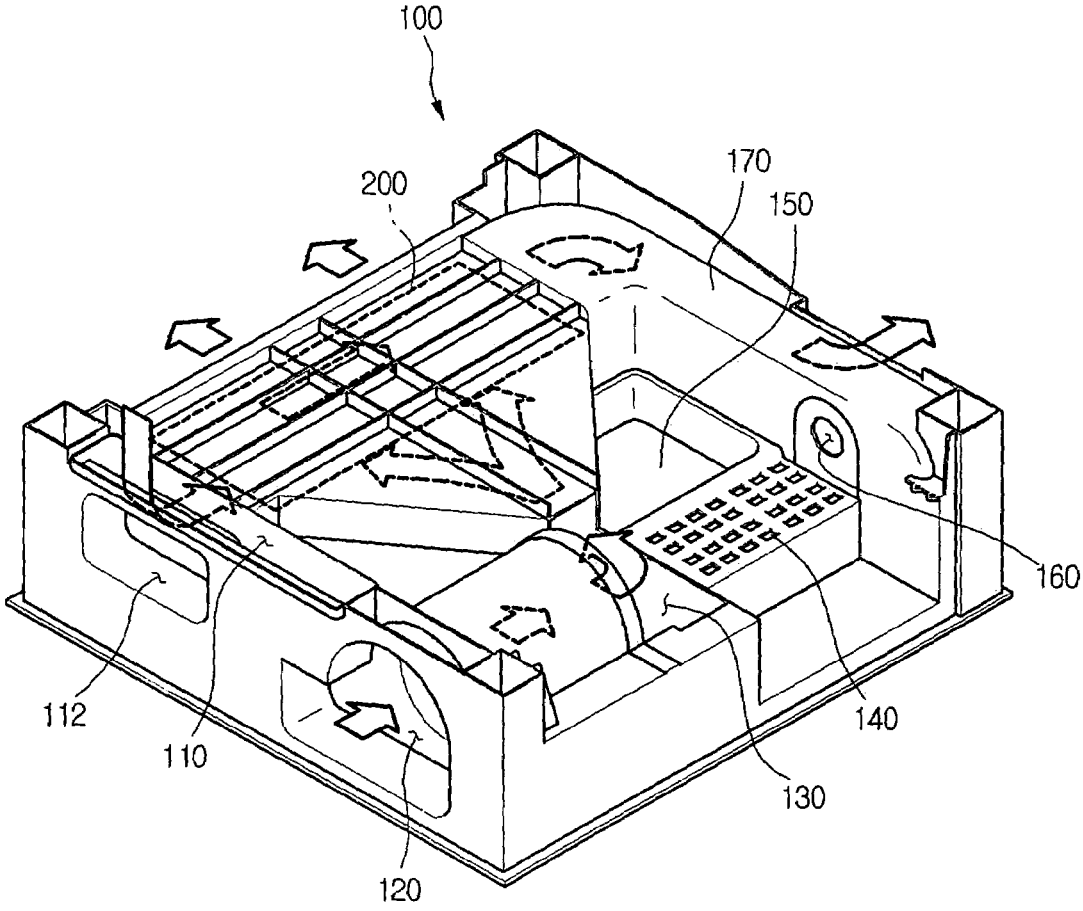
FIG. 2 is a perspective view of a base in which a condenser is inserted according to an embodiment of the present invention.

FIG. 2 is a perspective view of the base in which the condenser according to an embodiment of the present invention is inserted.

Referring to FIG. 2, the base 100 for receiving the condenser 200 includes a circulating air descending part 110 by which the interior air passing through the door lint filter 13*a* via the drum 12 is descended, a condenser insertion opening 112 in which the condenser 200 is inserted rearward, and a circulating air passage 170 extending from a rear end of the condenser 200 to guide the flow of the air passing through the condenser 200.

The base 100 further includes an interior air intake hole 120 spaced away from the condenser insertion opening 112 to intake the interior air and a cooling fan seating groove 130 on which the cooling fan 16 for introducing the interior air is seated.

The motor 17 is seated on a rear side of the cooling fan seating groove 130 and a heat discharge groove 140 for discharging the heat generated from the motor 17 is also formed on the rear side of the cooling fan seating groove 130. The sump 150 is provided on a center of the base 100 to accumulate the condensed water generated by the condenser 200 therein.

The fluid circulation in the base 100 will be briefly described hereinafter.

As described above, the circulating air changed into the high temperature/damp state as it passes through the drum passes through the door and body lint filters 13*a* and 14*a*. The interior air introduced through the interior air intake hole 120 is directed to the condenser 200 via the cooling fan 16.

Here, since the temperature of the interior air is lower than the circulating air, heat exchange is incurred between them as they pass through the condenser 200.

That is, the circulating air and the interior air are not mixed with each other but heat-exchanged with each other. The condenser 200 is designed such that the circulating air and the interior air cross each other therein.

The circulating air passing through the condenser 200 is directed to the dry duct 20 provided on a rear wall of the dryer along the circulating air passage 170 is then exhausted to the interior side.

Figure 3:
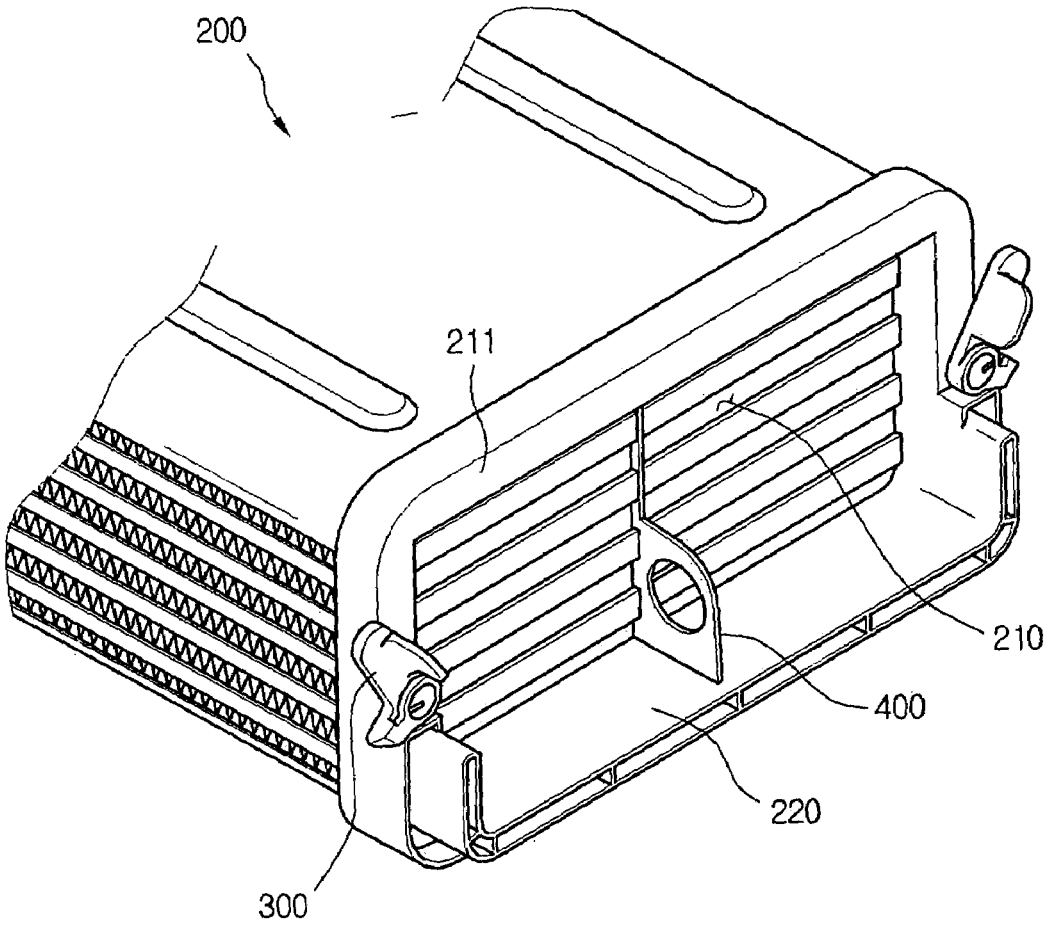
FIG. 3 is a front perspective view of a condenser according to an embodiment of the present invention.
Figure 4:
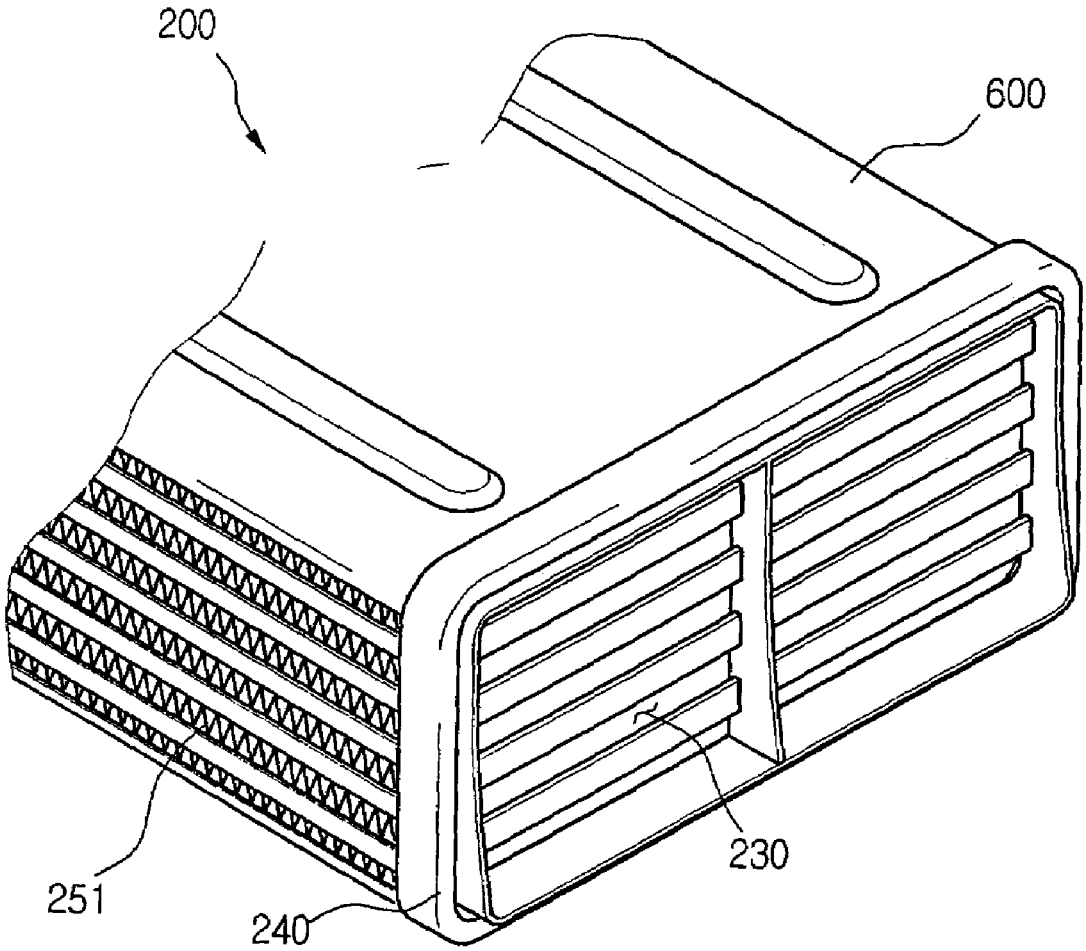
FIG. 4 is a rear perspective view of a condenser depicted in FIG. 3.
Figure 5:
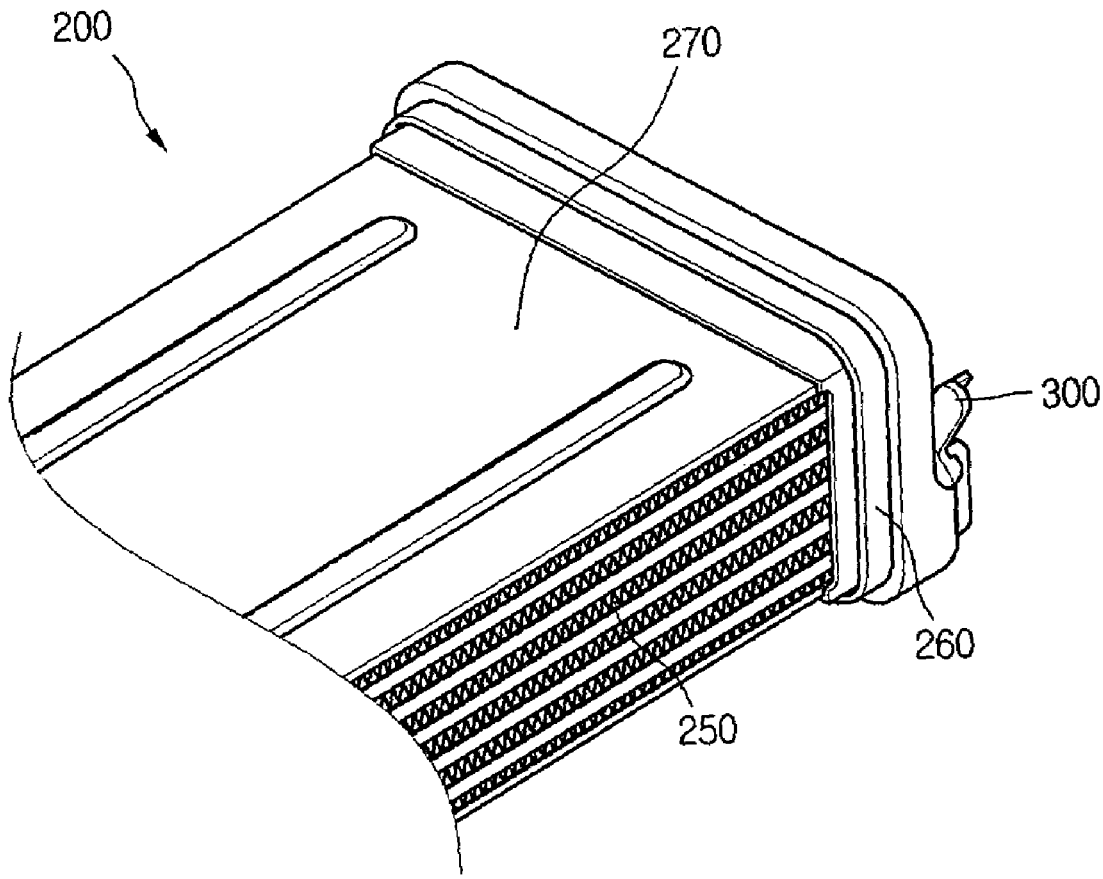
FIG. 5 is a side perspective view of a condenser depicted in FIG. 3.

FIGS. 3 through 5 show the condenser according to an embodiment of the present invention.

Referring to FIGS. 3 through 5, the inventive condenser 200 includes a main body 270, a front frame formed on an edge of a front portion of the main body 270, a circulation air intake hole 210 formed in the front frame 211, a condenser handle ring 400 formed on a front center of the condenser 200, a condenser insertion fastening member 300 formed on both sides of the front frame 211 to forcedly insert the condenser 200, and a front sealing seat 220 further extending frontward than the front frame 211.

That is, a front sealing member 260 is formed on a rear surface of the front frame 211 to maintain a seal state when the condenser is assembled.

A rear sealing member 240 formed on a rear end ends of the condenser 200 to maintain a seal state. A circulating air exhaust hole 230 for exhausting the interior air introduced through the circulating air intake hole 210 is further provided.

The condenser 200 is provided at a side portion with interior air intake and exhaust holes 251 and 250 for introducing and exhausting the interior air introduced by the cooling fan 16.

The circulation air intake and exhaust holes 210 and 230 and the interior air intake and exhaust holes 251 and 250 are disposed at a different layer to intersect each other so that the circulating air and the interior air are not mixed with each other but heat-exchanged with each other.

In addition, by the front and rear sealing members 260 and 240 of the condenser 200, the interior air and the circulating air passing through the condenser 200 cannot pass through an inside of the condenser and be leaked out of the condenser 200.

Here, in order to allow the sealing members 240 and 260 to be effectively operated, there is a need for a unit that can allow the condenser 200 tightly contacts a condenser seating portion (not shown).

Figure 6:
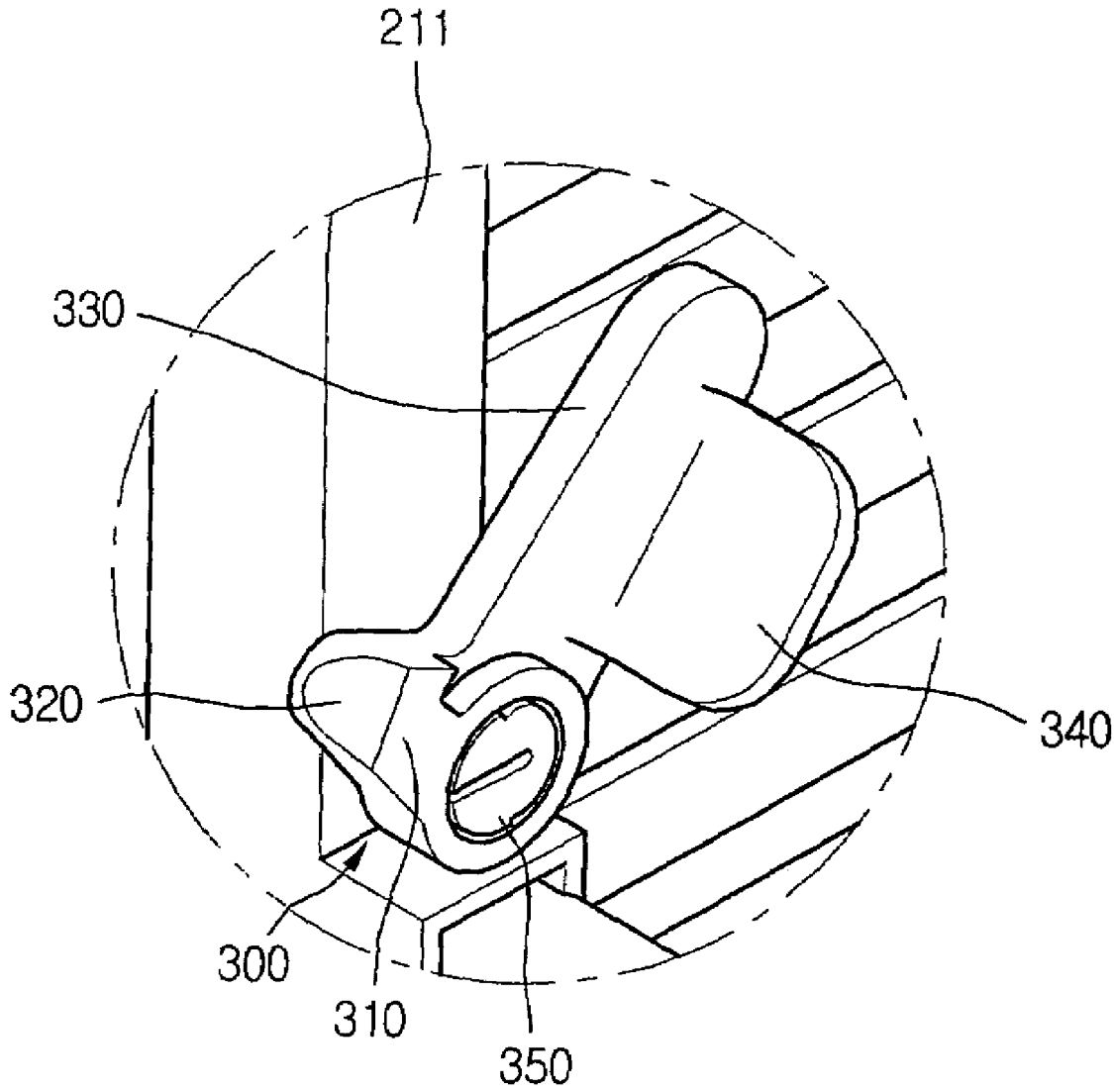
FIG. 6 is an enlarged perspective view of a condenser insertion fastening member according to an embodiment of the present invention.
Figure 7:
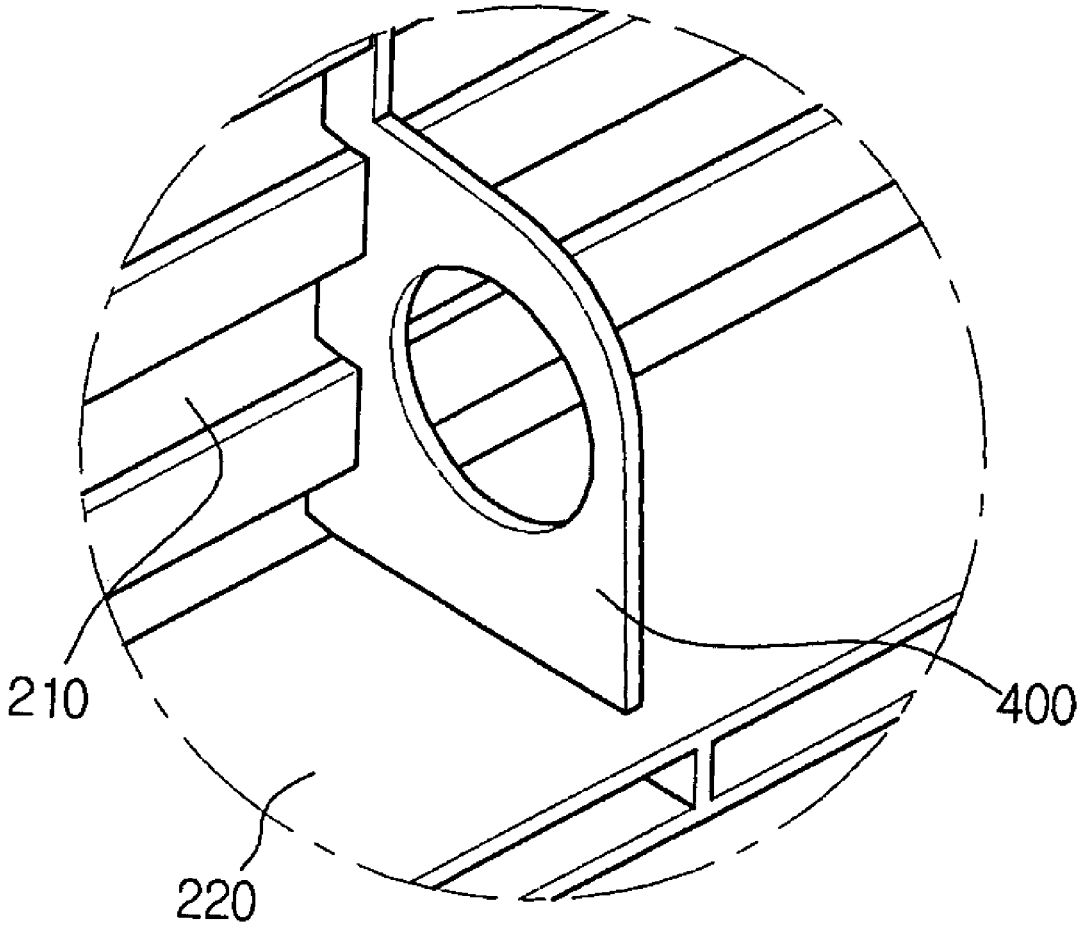
FIG. 7 is an enlarged perspective view of a handle ring provided on a condenser according to an embodiment of the present invention.

FIG. 6 shows an enlarged perspective view of the condenser insertion fastening member according to an embodiment of the present invention and FIG. 7 shows an enlarged perspective view of the handle ring provided on the condenser according to an embodiment of the present invention.

Referring to FIGS. 6 and 7, the condenser insertion fastening member 300 is mounted on both sides of the front frame 211 defining the front edge of the condenser 200.

That is, the insertion fastening member 300 includes a rotational center shaft 350 that is coupled to the front frame 211.

The rotational shaft 350 is preferably formed in a screw-shape so that the rotational shaft 350 can be screw-coupled to the front frame 211. The insertion fastening member 300 is designed to rotate by a predetermined angle around the rotational shaft 350.

The insertion fastening member 300 further includes a rotational lever 330 extending at a predetermined length and an insertion projection 310 extending from an end portion of the rotational lever 330.

Describing in more detail, the insertion projection 310 formed on an outer circumference of the insertion fastening member 300 has a predetermined thickness and an inclined insertion surface 320 is formed on an extreme end of the insertion projection 310 so that a width of the insertion projection 310 is reduced as it goes toward the extreme end.

Accordingly, when the insertion projection 310 is inserted in an insertion hole 111 formed on a side surface of a condenser receiving unit (see FIG. 8), the insertion projection 310 can be smoothly inserted in the insertion hole 111 by the inclined insertion surface 320.

The condenser handle ring 400 is formed on the front surface of the condenser so that the user can insert a finger into the ring 400.

That is, there is a need to periodically clean the condenser after removing the condenser 200 from the dryer. Therefore, a handle is required for the user to easily remove the condenser 200. The handle ring 400 plays a role in this function.

The condenser handle ring 400 is vertically formed on the front seal seat 220 provided on a front lower portion of the condenser and the handle ring 400 defines a hole having a predetermined diameter.

The forming location of shape of the handle ring is not limited to the above. A variety of other structures that can provide the convenience for the user to grasp the condenser will be possible.

Figure 8:
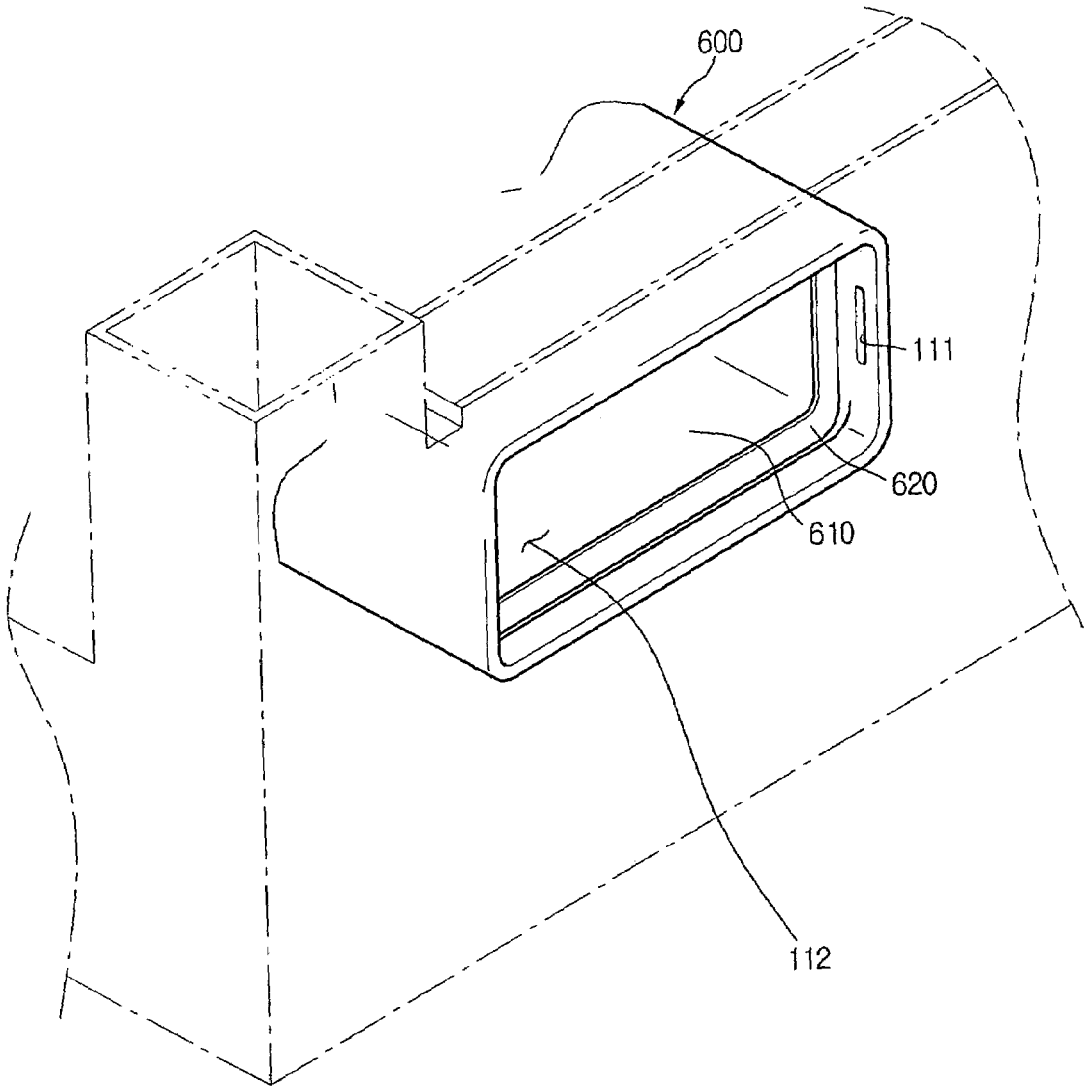
FIG. 8 is a partial perspective view of a condenser receiving unit according to a first embodiment of the present invention.
Figure 9:
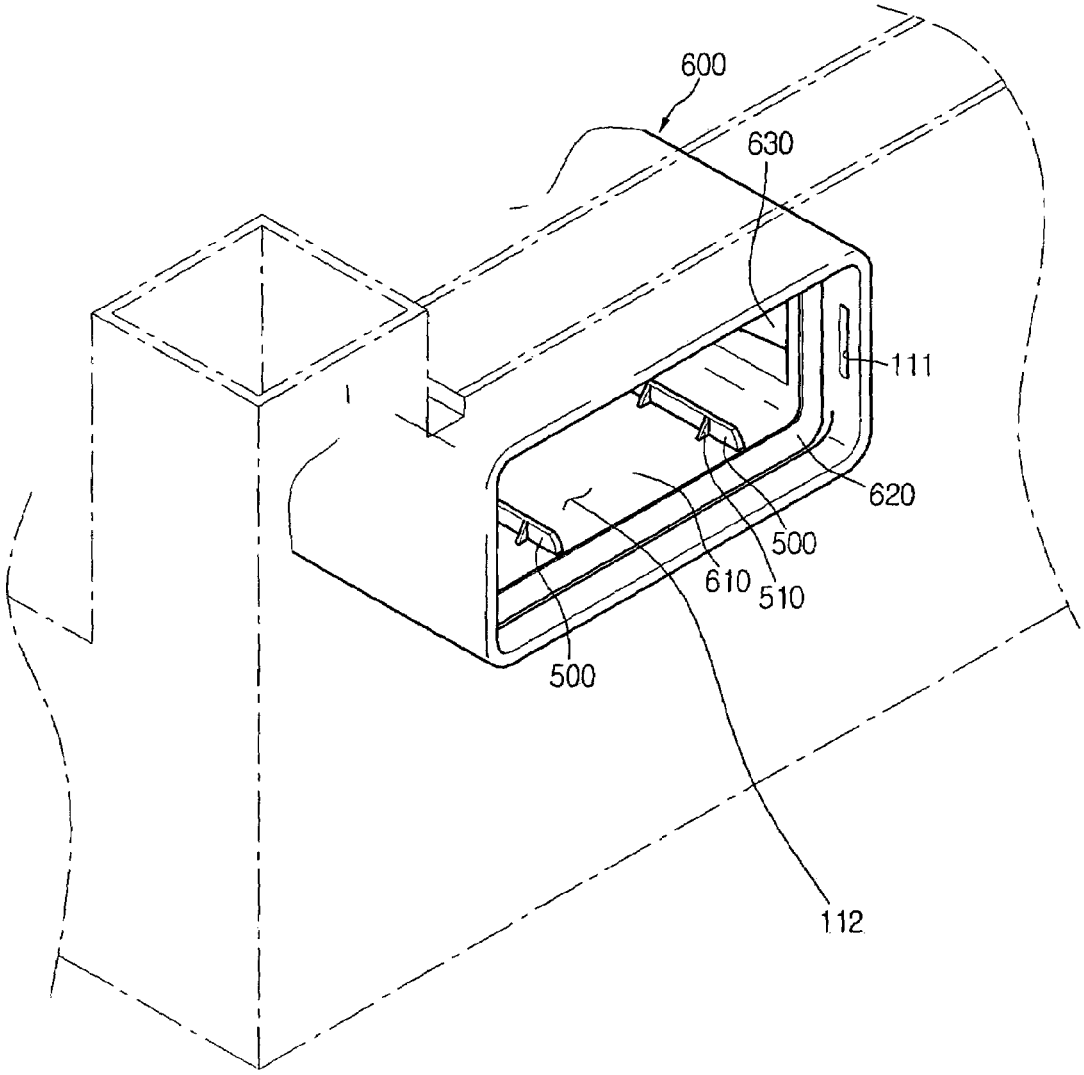
FIG. 9 is a partial perspective view of a condenser receiving unit according to a second embodiment of the present invention.

FIG. 8 shows a partial perspective view of the condenser receiving unit according to a first embodiment of the present invention and FIG. 9 shows a partial perspective view of the condenser receiving unit according to a second embodiment of the present invention.

Referring to FIGS. 8 and 9, the condenser receiving unit 600 formed on the base 100, having a predetermined depth.

That is, the condenser receiving unit 600 includes the condenser insertion opening 112 formed on the front surface of the base 100 to receive the condenser 200, a front sealing flange 620 disposed around an inner circumference of a portion located at a predetermined depth from the condenser insertion opening 112, and an insertion hole 111 formed on one of the both sides of the condenser receiving unit 600 to receive the insertion projection 310. The condenser receiving unit 600 includes an interior air intake hole 630 through which the interior air is introduced by the cooling fan 16. The interior air intake hole 630 is formed on a side of the condenser receiving unit 600.

The front sealing flange 620 contacts the front sealing member 260 provided on a rear surface of the front frame 211 of the condenser 200 so as to prevent the circulating and interior airs introduced into the condenser 200 from being leaked through the front portion of the base 100.

The condenser 200 according to the present invention inserted in the condenser receiving unit 600 provided on an edge of the base 100 of the dryer 30. At this point, the condenser receiving unit 600 has an identical shape to that of the front portion of the condenser. A guide rail 500 is formed on a bottom 610 of the condenser receiving unit 600, extending in a longitudinal direction with a predetermined height.

As described above, when the condenser 200 is received in the condenser receiving unit 600, lower frictional force acts, thereby making it possible for the condenser to be smoothly inserted into the condenser receiving unit 600.

Here, at least one supporting rib 510 supporting the guide rail 500 may be formed on one of the both sides of the guide rail 500.

The height, length and number of the guide rail 500 provided on the bottom 610 of the condenser receiving unit are not limited to this embodiment.

Figure 10:
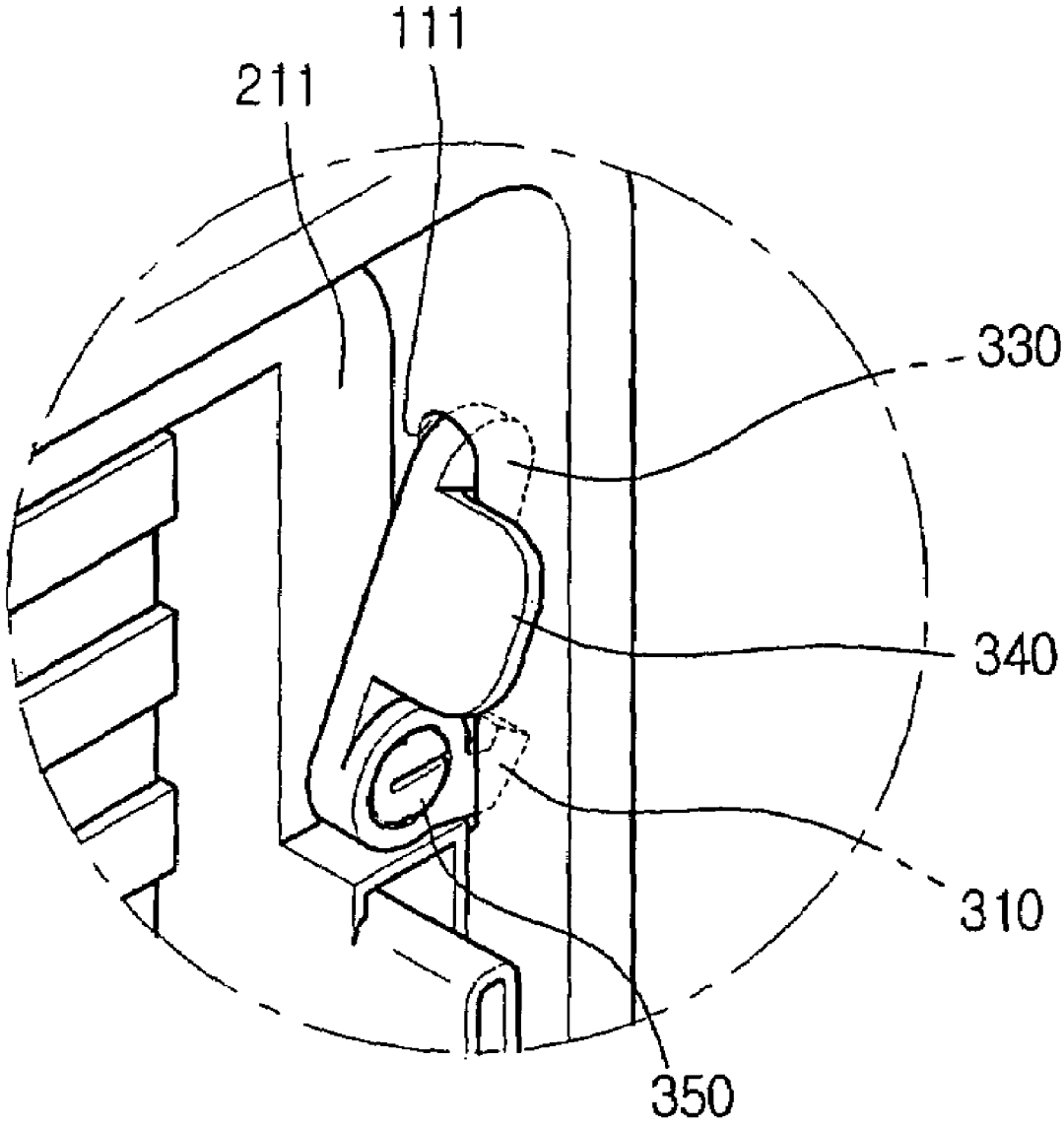
FIG. 10 is an enlarged view of a state where a condenser is forcedly fitted by an insertion fastening member according to an embodiment of the present invention.

Referring to FIG. 10, when the condenser insertion fastening member 300 is inserted through the insertion hole 111 formed on the side portion of the condenser receiving unit 600, the rear surface of the condenser 200 tightly contacts the condenser receiving unit 600, thereby preventing the air from being leaked.

The process for forcedly inserting the insertion fastening member 300 into the condenser 200 will be described hereinafter.

The condenser 200 is first inserted into the condenser receiving unit 600. When the condenser 200 is completely inserted into the receiving unit 600, the bottom of the insertion projection 310 is located on the insertion hole 111. In this state, when the user rotates the insertion projection in a state where the user grasps the handle ring 340, the insertion projection 310 is inserted into the insertion hole 111 along the inclined insertion surface 320.

As a result, when the insertion projection 310 is completely inserted into the insertion hole 111, the condenser 200 is forcedly inserted by a thickness corresponding to a thickness of the insertion projection 310. Accordingly, the sealing member provided on the front surface of the condenser 200 tightly contacts the front sealing surface 620 formed on the condenser receiving unit 600, thereby providing a sight seal. The rear sealing member 240 provided on a rear edge of the condenser 200 tightly contacts the sealing surface formed on the rear surface of the condenser receiving unit 600.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A laundry dryer comprising:

a base for the laundry dryer;

a condenser receiving unit having a sealing member and being formed in the base;

a sealing member formed on one of front and rear surfaces of the condenser, and a condenser inserted in the condenser receiving unit and provided with an insertion fastening member to cause the receiving unit sealing member to tightly contact the condenser surface sealing member to prevent air passing through the condenser from leaking out of the dryer.

2. The laundry dryer according to claim 1, wherein the condenser receiving unit is provided at one of both sides with an insertion hole in which the insertion fastening member is inserted.

3. The laundry dryer according to claim 1, wherein a sealing member is provided on bath front and rear surfaces of the condenser to prevent air passing through the condenser from leaking out of the dryer.

4. The laundry dryer according to claim 1, wherein the condenser is provided at a front surface with a handle ring.

5. The laundry dryer according to claim 1, wherein the condenser has a front lower portion extending further than a front upper portion.

6. The laundry dryer according to claim 1, wherein the insertion fastening member is provided at a center with a rotational shaft.

7. The laundry dryer according to claim 1, wherein the insertion fastening member includes an insertion projection inserted in a side portion of the condenser receiving unit.

8. The laundry dryer according to claim 1, wherein the insertion fastening member includes an insertion projection having an inclined top.

9. The laundry dryer according to claim 1, wherein the insertion fastening member has an insertion projection having a thickness that is reduced at it goes toward an extreme end.

10. The laundry dryer according to claim 1, wherein the insertion fastening member is provided at an outer circumference with a rotatable insertion lever.

11. The laundry dryer according to claim 10, wherein the insertion lever includes a handle extending frontward.

12. The laundry dryer according to claim 1, wherein the insertion fastening member is formed through a plastic injection molding process.

13. The laundry dryer according to claim 4, wherein a handle ring defines a hole in which a user's finger can be inserted.

14. The laundry dryer according to claim 1, wherein the condenser receiving unit comprises a guide rib elevated at a predetermined height and extending at a predetermined length.

15. The laundry dryer according to claim 14, wherein the condenser receiving unit comprises a supporting rib supporting the guide rib.

16. A laundry dryer comprising:

a condenser;

a handle ring formed on a front portion of the condenser;

an insertion fastening member rotatably mounted on the front portion of the condenser;

a base having a concave portion for receiving the condenser, the base being provided at a concave portion with a groove in which the insertion member is coupled; and a sealing surface elevated from the concave portion by a predetermined height and contactable to a condenser seating portion for preventing circulating air passing through the condenser from leaking out of the condenser.

17. The laundry dryer according to claim 16, wherein the insertion fastening member comprises an insertion projection inserted in the groove and a rotational member extending from the insertion projection.

18. The laundry dryer according to claim 16, further comprising a sealing member disposed around the condenser to contact a sealing surface for preventing circulating air passing through the condenser from leaking out of the condenser.

19. The laundry dryer according to claim 16, wherein the handle ring extends from a bottom of the condenser at a predetermined height.

20. The laundry dryer according to claim 16, wherein the condenser is provided at a bottom with a guide surface for guiding introduction of circulating air.

21. The laundry dryer according to claim 16, wherein the insertion fastening member is formed on both sides of the condenser.

22. The laundry dryer according to claim 16, wherein the concave portion is provided at a bottom with a longitudinal guide portion for reducing frictional force with the condenser.

23. A laundry dryer comprising:

a drum;

a condenser in which circulating air passing through the drum is introduced and heat-exchanged with interior air;

a base having a receiving unit for receiving the condenser;

an insertion fastening member mounted on front both sides of the condenser to allow the condenser to tightly contact the receiving unit; and a guide rib formed in the receiving unit to allow the condenser to be smoothly inserted.

24. An integrated base for a clothes dryer, comprising:

a circulating air descending part;

a condenser insertion opening through which the condenser is insertable;

a circulating air passage extending from a rear end of the condenser to guide air flow through the condenser;

an interior air intake hole spaced away from the condenser insertion opening for permitting intake of air;

a cooling fan seating groove for supporting a cooling fan;

a motor seat located on a rear side of the cooling fan seating groove; and a sump located in the base for accumulating condensed water from the condenser, wherein the aforementioned features are in an integrated unit.

25. A laundry dryer comprising:

a base for the laundry dryer;

a condenser receiving unit formed in the base; and a condenser inserted in the condenser receiving unit and provided with an insertion fastening member provided at its center with a rotational shaft about which it rotates to fasten the condenser to the condenser receiving unit.

* * * * *